US006219512B1

(12) United States Patent
Saitoh

(10) Patent No.: US 6,219,512 B1
(45) Date of Patent: Apr. 17, 2001

(54) TONER IMAGE DRYER FOR A WET ELECTROPHOTOGRAPHIC RECORDING SYSTEM

(75) Inventor: Junichi Saitoh, Yamagata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/544,842

(22) Filed: Apr. 6, 2000

(30) Foreign Application Priority Data

Apr. 8, 1999 (JP) ..... 11-101721

(51) Int. Cl.[7] ..... G03G 15/10; G03G 21/00
(52) U.S. Cl. ..... 399/249; 399/348; 399/352
(58) Field of Search ..... 399/348, 349, 399/71, 249, 352, 251

(56) References Cited

U.S. PATENT DOCUMENTS 3,510,903 * 5/1970 Stoever et al. .
5,911,101 * 6/1999 Park ..... 399/71 X
6,064,851 * 5/2000 Saitoh ..... 399/348

FOREIGN PATENT DOCUMENTS 54-131940 10/1979 (JP) .
57-32472 2/1982 (JP) .
62-32484 2/1987 (JP) .
6-75510 3/1994 (JP) .
9-244495 9/1997 (JP) .
11-73024 3/1999 (JP) .

* cited by examiner

*Primary Examiner*—Susan S. Y. Lee
(74) *Attorney, Agent, or Firm*—Ostrolenk, Faber, Gerb & Soffen, LLP

(57) ABSTRACT

A toner image dryer is constituted to include a drying belt 11 having a functional material coated on a film surface of a base material, a pressure-contact roller rotated following rotation of an opposing drive roller for rotating and moving a drive belt having a photosensitive body on a surface of the belt by friction torque, with the drying belt 11 and the drive belt interposed between the pressure-contact roller and the opposing drive roller, a heat roller for heating the drying belt and a TS roller for applying predetermined tension to the drying belt, and to rotate and move the drying belt to thereby heat the belt to a predetermined temperature by the heat roller and to allow the drying belt to absorb and vaporize solvent from the photosensitive body closely attached between the opposing drive roller and the pressure-contact roller.

4 Claims, 4 Drawing Sheets

TONER IMAGE DRYER FOR A WET ELECTROPHOTOGRAPHIC RECORDING SYSTEM

BACKGROUND OF THE INVENTION

1. Field of the Invention

The present invention relates to a toner image dryer applied to a wet electrophotographic recording system such as a copying machine and a printer using a liquid developing process, for selectively absorbing only liquid carriers from a development liquid for adjusting transfer conditions.

2. Description of the Related Art

A conventional image printer using wet electrophotographic recording system, has an photosensitive belt (photosensitive body) formed with a photosensitive material, a charger for charging the photosensitive belt, optical exposing unit for forming an electrostatic image on the charged photosensitive belt, development device for forming a toner image by using a development liquid, and transfer and fixing device for transferring the toner image to a recording medium and fixing thereon. Usually, the development liquid used in the development device mainly has toners and liquid carriers for charging toners so as to selectively develop toner grains and dispersing the toners in the development liquid.

In the conventional image printer of this type, it is necessary to selectively absorb the liquid carriers after developing a toner image on photosensitive belt with the development liquid and before transferring the image onto the recording medium. This is because the toner image is set in a filmed state to have a solid component ratio of not less than 95% to thereby adjust transfer conditions.

For absorbing the liquid carriers from the development liquid, a toner image dryer is used in the image printer. Usually, the toner image dryer is provided by a heat roller which contacts on the photosensitive body. The heat roller absorbs the liquid carriers from the photosensitive belt formed with the toner image, and vaporizes from the liquid carriers by heating the roller and diffusing to set in a filmed state to have a solid component ratio of not less than 95%.

But, it is difficult to maintain a balance between absorption and diffusion/vaporization at not more than the heat resisting temperature of the photosensitive belt.

Furthermore, in the conventional roller type drier, image picking due to shearing force at an absorbing and contact part (NIP part) progresses and so does ink contamination in the image drying system accordingly, with the result that it becomes difficult to realize an intended service life.

SUMMARY OF THE INVENTION

It is, therefore, an object of the present invention to provide a toner image drier capable of obtaining a good image by preventing an image drying defect derived from ink contamination, and ensuring a lengthened service life.

According to the present invention, a toner image dryer for a wet electrophotographic recording system for forming a toner image on a photosensitive body by a liquid development, has a drying belt having a functional material coated on a film surface of a base material; a pressure-contact roller which contacts with the drying belt to cause the drying belt to be contacted on the photosensitive body and rotates with the photosensitive body; a heat roller for heating the drying belt; and tension application member for applying predetermined tension to said drying belt. And the drying belt is rotated and moved to be thereby heated by the heat roller, and the drying belt absorbs and vaporizes solvent from the photosensitive.

In this case, a cleaning mechanism for recovering ink adhering to the drying belt from the photosensitive body may be provided. Also, rubber beads may be provided on the back surface of the drying belt.

Further, the tension application means may be either an independent roller or integral with a heat roller.

The drying belt is, most preferably, made of a PET (polyethylene terephthalate) base material.

According to such a toner image dryer, even if the vaporization temperature of the heat roller is set higher, it is possible to suppress the surface temperature of the pressure-contact roller low and, therefore, to accelerate the recovery of steam while preventing image picking caused by the pressure-contact roller.

BRIEF DESCRIPTION OF THE DRAWINGS

FIG. 4A is a partially cross-sectional view showing a layered structure, and FIG. 4B is a cross-sectional view of FIG. 4A.

DETAILED DESCRIPTION OF THE PREFERRED EMBODIMENTS

Figure 1:
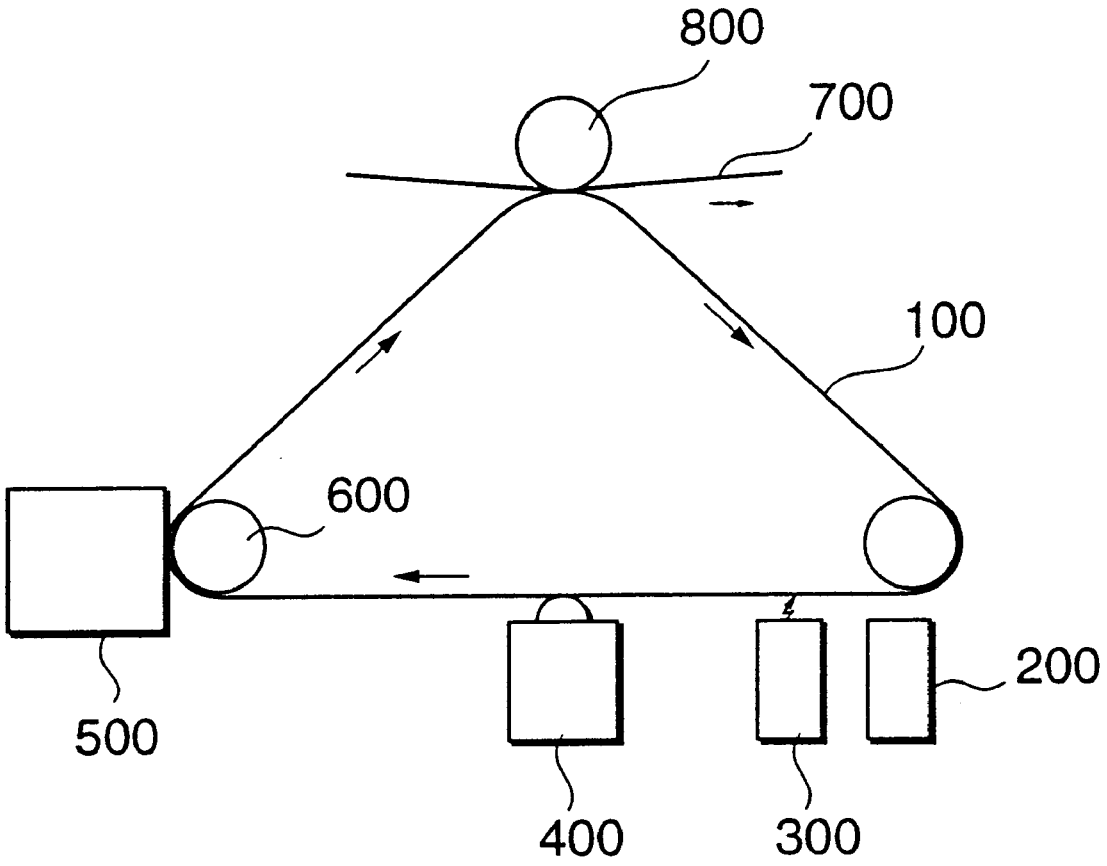
FIG. 1 is a block diagram of a image printer using the toner image dryer of the first embodiment of the present invention.

A toner image drier of the embodiment of the present invention is assembled into an image printer of FIG. 1 using a conventional wet electrophotographic recording system. In FIG. 1, the image printer has a photosensitive belt 100 formed with a photosensitive material, a charger 200 for charging the photosensitive belt 100, optical exposing unit 300 for forming an electrostatic image on the charged photosensitive belt 100, development device 400 for forming a toner image on the photosensitive belt 100 by using a development liquid, a toner image dryer 500 for drying the toner image, and transfer and fixing device 600 for transferring the toner image to a sheet of paper 700 and fixing the toner image thereon.

The photosensitive belt 100 has an endless base belt and photosensitive film and layer formed on the outer surface of the endless base belt.

The development liquid used in the development device 400 mainly has toners and liquid carriers for charging toners so as to selectively develop toner grains and dispersing the toners in the development liquid.

The toner image dryer 500 dries a toner image formed by the development liquid on the photosensitive belt 100 by absorbing and eliminating the liquid carriers from the toner image formed by the development liquid before transferring the toner image onto the sheet 700, so that the toner image is set in a filmed state with a solidified component ratio of not less than 95% and thereby adjusts transfer conditions.

Figure 2:
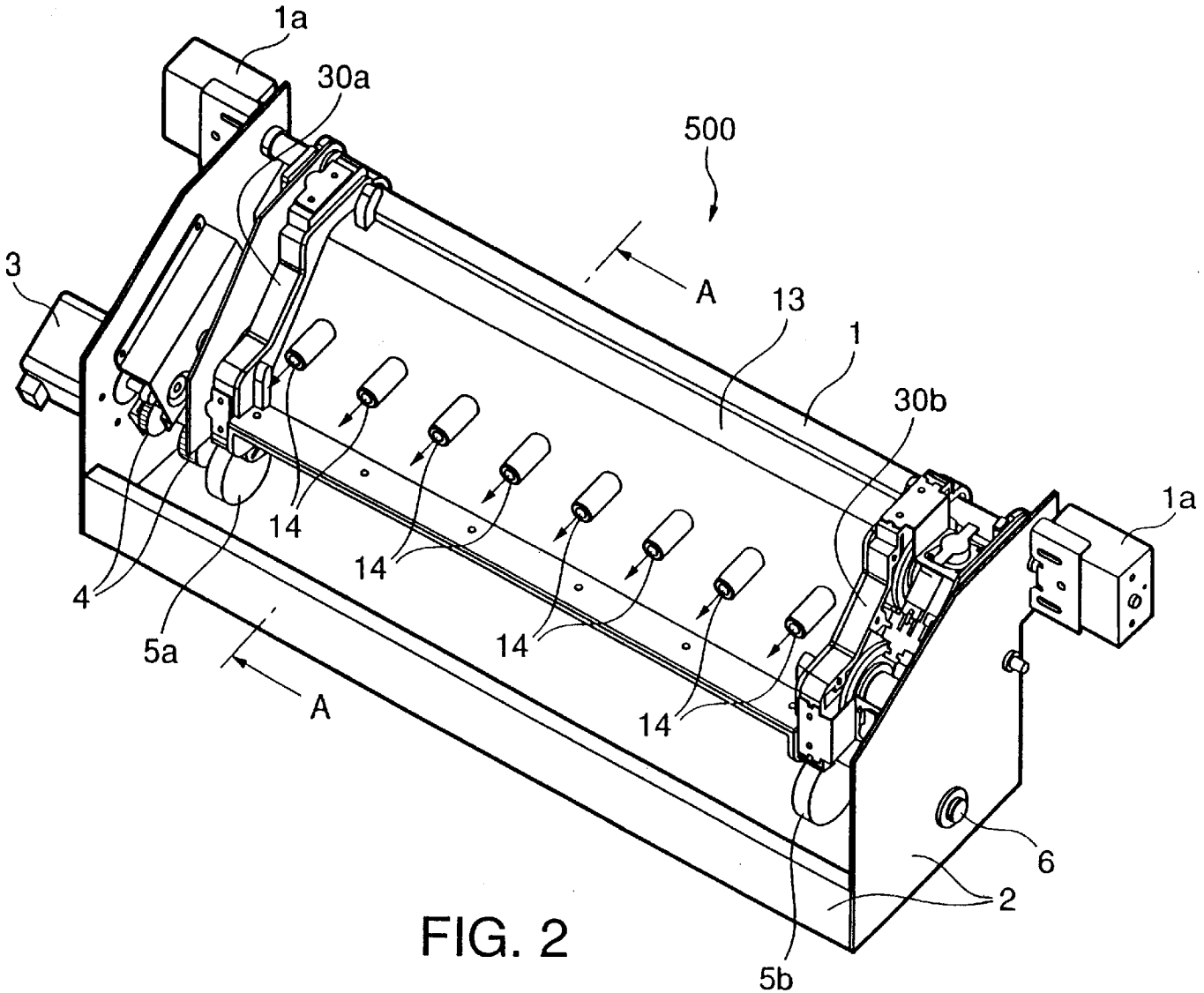
FIG. 2 is a perspective view showing the toner image dryer of the first embodiment of the present invention.
Figure 3:
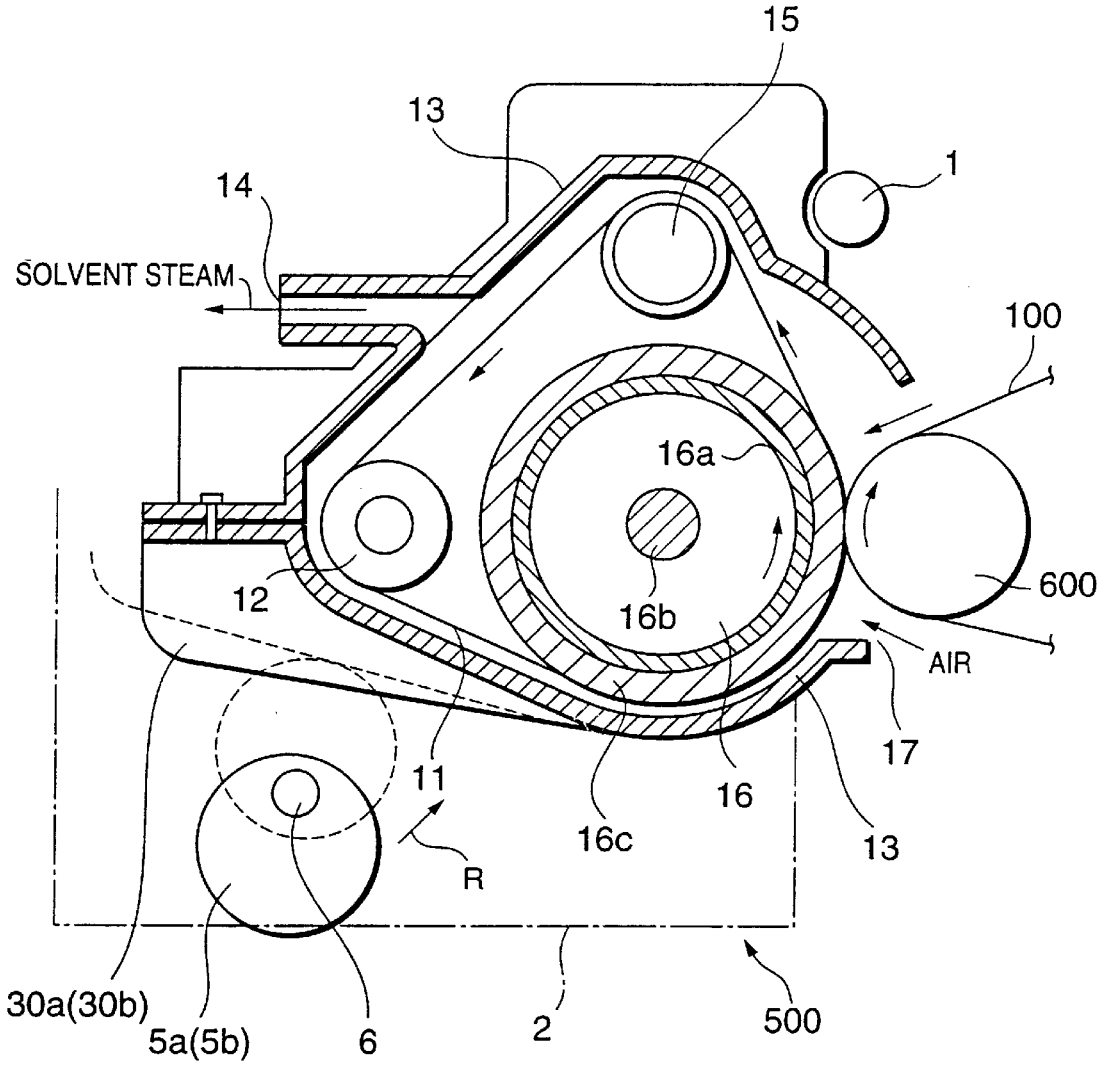
FIG. 3 is a A—A cross-sectional view of FIG. 2.

FIG. 2 is a perspective view of the toner image dryer 500 as the first embodiment according to the present invention and FIG. 3 is a cross-sectional view of FIG. 1. In FIG. 2, the toner image dryer has a fixing shaft 1 formed with couplings la fixed to the image printer of FIG. 1, a frame 2, motor 3, gears 4, cams 5*a*, 5*b*, cam shaft 6, manifold 13 and side holders 30*a* , 30*b* fixed to the manifold 13. The frame 2 is fixed to the fixing shaft 1. The motor 3 is fixed on one side of the frame 2. The gears 4 coupled to the motor 3 and connected to the cam shaft 6 to rotate it. The cams 5*a* and 5*b* are formed with the cam shaft 6 and thereby they are rotated by the motor 3.

The side holders 30*a* and 30*b* are located in the side direction of the manifold 13 and fixed to the manifold 13. The upper portions of the side holders 30*a* and 30*b* are coupled to the fixing shaft 1 with allowing rotary motion of the side holders 30*a* and 30*b* (and manifold 13). The rotary motion is performed by the cams 5*a* and 5*b* which are located under the side holders 30*a* and 30*b*.

In the manifolds 13*a*, 13*b*, as shown in FIG. 3, there is a drying belt 11, a tension steering roller (to be referred to as "TS roller") 12 provided as tension application means, a heat roller 15, and a pressure-contact roller 16. The pressure-contact roller 16 contacts to the photosensitive belt 100 formed with the toner image opposing to an opposing drive roller (to be referred to as "OPR roller" hereinafter) 6.

As shown in FIG. 1, the ends of the TS roller 12, heat roller 15 and pressure-contact roller 16 are located and supported in the side holders 30*a* and 30*b*.

Figure 4A:
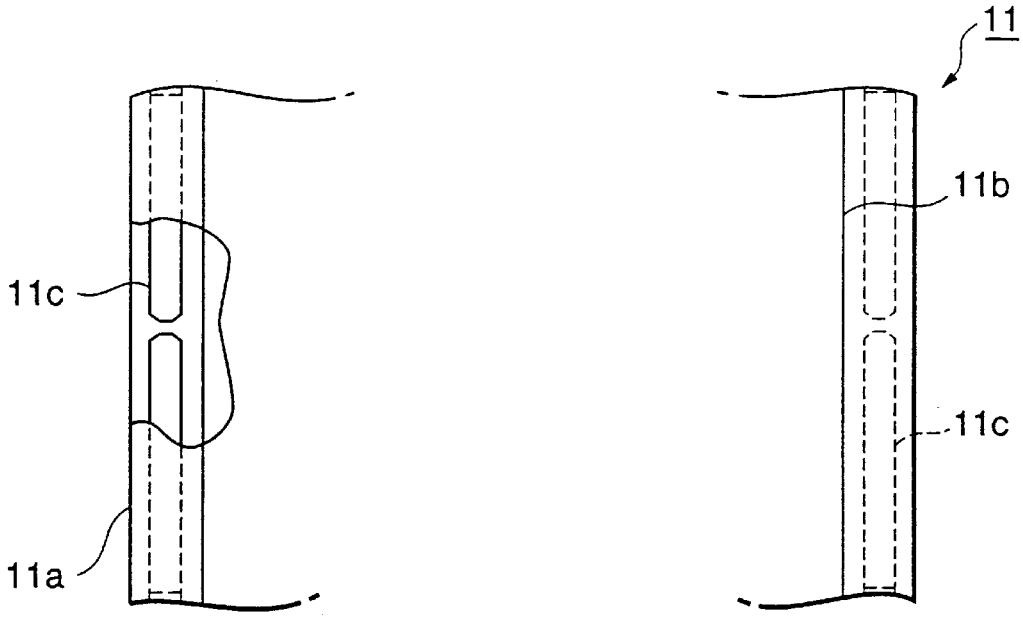
FIGS. 4A and 4B show the constitution of a drying belt shown in FIG. 3, where
Figure 4B:
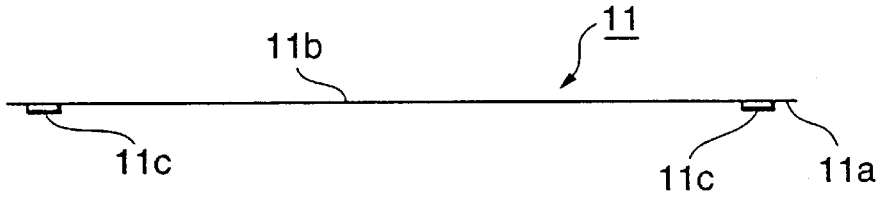

As shown in FIGS. 4A and 4B, the drying belt 11 has a layered structure in which an inexpensive PET base material 11*a* is used as a film-like base material and a silicon polymer absorbent material 11*b* is coated, as a functional material, on the surface of the base material 11*a*. In addition, for the purpose of snaking movement control, beads 11*c* made of rubber are provided in the vicinity of both side end portions of the back surface of the PET base material 11*a*, respectively. The bead 11*c* is elongated, projecting portions continuous to or extending intermittently toward the travelling direction of the drying belt 11. In a preferred example, the bead 11*c* is made of VITON rubber with a thickness of about 3 to 5 mm and a height of about 1 mm. Further, the PET base material 11*a* has a thickness of about 0.01 mm, and the absorbent material 11*b* has a thickness of about 0.02 to 0.06 mm.

In the present invention, a process for absorbing and then diffusing/vaporizing solvent by using the drying belt 11 is carried out. For that reason, the drier of the present invention can be referred to as a belt type toner image dryer opposed to the conventional roller type toner image dryer described in "Prior Art" part.

The drying belt 11 is of ring shape with both ends coupled to each other and circulates on the outer peripheral surfaces of the TS roller 12, the heat roller 15 and the pressure-contact roller 16 arranged in a generally triangular manner.

The pressure-contact roller 16 has an urethane rubber 16*c*, with which the solvent in the development liquid is not swollen, molded on the surface of a core material consisting of a drawing tube 16*a* made of aluminum or stainless (SUS) and a shaft 16*b* made of SUS material. This pressure-contact roller 16 is maintained in a state in which the roller 16 is pressure-contacting with the OPR roller 600 for rotating the photosensitive belt 100 with the drying belt 11 and the photosensitive belt 100 interposed between the roller 16 and the OPR roller 600. As a result, the pressure-contact roller 16 is rotated following the rotation of the OPR roller 600 by friction torque.

The heat roller 15 includes a heating source such as a halogen lamp, heats the drying belt 11 at a certain temperature and vaporizes the solvent absorbed by the absorbent material 11*b*. Depending on process conditions, vaporization temperature ranges from about 80 to 100° C.

Next, the TS roller 12 functions to apply optimum tension, which is within the breaking strength of the drying belt 11 and with which the drying belt 11 is not slipped between the photosensitive belt 100 and the pressure-contact roller 16, to the drying belt 11 and to maintain the belt 11. The TS roller 12 also has a mechanism for controlling snaking movement generated due to the positioning accuracy of each of the rollers 12, 15 and 16 as well as irregularity in the laterally peripheral length of the drying belt 11.

The drying belt 11, the TS roller 12, the heat roller 15 and the pressure-contact roller 16 are covered with the manifold 13 except for a pressure-contact part between the pressure-contact roller 16 and the OPR roller 600. The manifold 13 is provided with an exhaust port 14 from which vaporized solvent is attracted. Opening portions provided on upper and lower portions of the pressure-contact part, respectively, serve as air inlets 17 from which air is sucked. With this constitution, the solvent absorbed by means of the drying belt 11 can be recovered and then recycled. The solvent swollen to the silicon coating material (absorbent material 11*b*) on the surface of the drying belt 11 is vaporized within the tight sealed manifold 13 including the halogen lamp by the heat energy of the heat roller 15. The entire steam of the solvent is exhausted and recovered externally through the exhaust port 14 by a suction unit such as an air pump (not shown).

Now, the operation and function of the above-stated toner image dryer will be described.

In FIG. 3, when the cams 5*a* and 5*b* rotate in the arrow R and are positioned as shown in the broken line by the motor 3 (FIG. 2), the cams contact under the side holders 30*a* and 30*b* so that the manifold 13 rotate among the fixing shaft 1. In this case, the pressure-contact roller 16 is separated from the OPR roller 600 and does not contact with each other. When the toner image dryer 500 dried the toner image on the photosensitive belt 100, the cams 5*a* and 5*b* are positioned as shown by the real line in FIG. 3.

Among the image formed by the development liquid on the surface of the photosensitive belt 100, only the solvent other than the ink contained in the image is absorbed by the absorbent material 11*b* of the drying belt 11 by means of the capillary effect by a contact width in which the pressure-contact roller 16 and the OPR roller 600 contact with each other in a pressurized state. As a result, the image is formed into a film on the surface of the photosensitive body with a solid component ratio of not less than 95%, subjected to the following transfer and fixing steps and visualized on a recording medium such as a sheet.

Here, an ink component in the development liquid is prevented from moving from the Photosensitive belt 100 toward the drying belt 11 by surface energy on the surfaces of the respective belts. If the surface energy on the surface of the drying belt 11 is higher than that on the surface of the ink of the photosensitive belt 100, the ink is transferred onto the drying belt 11 by intermolecular force. Due to this ink contamination on the belt 11, the solvent is absorbed insufficiently to thereby cause an image defect.

The absorbed solvent is diffused into the surface material of the drying belt 11, that is, the absorbent material 11*b* of about 0.02 to 0.06 mm in length. However, since the drying belt 11 and the solvent are applied with heat and heated by the heat roller 15 in the range of 80 to 100° C., the solvent within the absorbent material 11*b* is vaporized. If the steam of the vaporized solvent is left as it is, it is changed to dew within the manifold 13. To prevent this, fresh air is taken in from the air inlets 17 and exhaust port 14 is provided on a portion on which upper and lower steam collide against each other, a flow velocity vector is small and steam stagnates, to thereby recover the steam altogether. It is noted that the manifold 13 is formed out of a material having a low heat conductivity.

In that case, it is also possible to provide a cleaning roller, as a cleaning mechanism for recovering the ink adhering to the drying belt 11, in the manifold 13. In the constitution shown in FIG. 1, however, it is necessary to give a due consideration to the arrangement of the cleaning roller in the tight-sealed manifold 13 so as not to decrease steam recovery efficiency.

Figure 5:
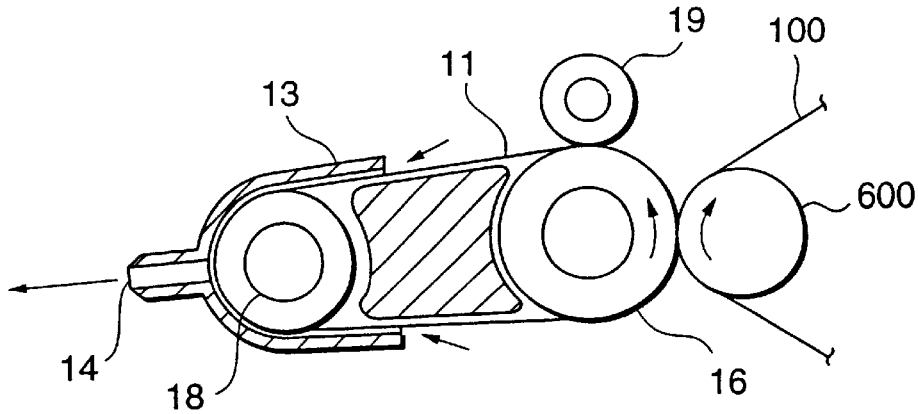
FIG. 5 is a cross-sectional view showing the second embodiment according to the present invention.

FIG. 5 shows the second embodiment of the belt type toner image dryer. The second embodiment differs from the first embodiment stated above in that a mechanism for transporting the drying belt 11 consists of two rollers instead of the three rollers, i.e., the TS roller 12, the heat roller 15 and the pressure-contact roller 15. The second embodiment has a simpler constitution by providing a steering heat roller 18 (to be referred to as "TSH roller" hereinafter) which is an integral roller of the TS roller 12 and the heat roller 15 shown in FIG. 11. The TSH roller 18 has a heat source such as a halogen lamp inside and functions to apply appropriate tension to the drying belt 11 to maintain the belt 11.

In FIG. 5, reference numeral 19 denotes a cleaning roller which can effectively function as a cleaning mechanism for recovering ink adhering to the drying belt 11. In this embodiment, a manifold 13 is provided to cover only the TSH roller 18 and the cleaning roller 19 can be, therefore, arranged outside of the manifold 13. Thus, the problem that the cleaning roller 19 hampers steam recovery does not occur.

The cleaning roller 19 is a cleaning mechanism intended to prevent an image drying part from being contaminated by the ink even if part of an image is separated from a photosensitive body due to image picking or the like. The ink separated from the photosensitive body and adhering to the drying belt 11 is recovered by the surface of the cleaning roller 19 by means of cohesion. In principle, the cleaning roller 19 utilizes the cohesion of the ink itself.

Rubber beads 11*c* provided on the back surface of the drying belt 11 for controlling snaking, function to generate friction so as to return the position of the drying belt 11 in a direction at right angle with a belt forward direction when the beads 11*c* contact with grooves (not shown) provided in the TS roller 12 or TSH roller 19 and the pressure-contact roller 16. They are useful to maintain stable rotational movement.

As stated so far, the toner image dryer according to the present invention is applied to an image printer intended to print, in particular, a wet, multicolor image with high quality and is thereby capable of printing a high quality image.

The toner image dryer according to the present invention has the following advantages:

(1) Since shearing force at an absorption part is reduced, it is possible to prevent image degradation.

(2) It is possible to improve solvent recovery by the lengthened absorption time (increased NIP width).

(3) It is possible to prevent image picking (image separation) from the photosensitive body by the decreased absorption temperature.

(4) Since vaporization time is lengthened (time for contact with the heat roller is extended), solvent regeneration capability and solvent recovery can be improved and it is possible to prevent the generation of dew in the manifold.

(5) Since solvent absorbing area enlarges, solvent absorption capacity can be increased.

(6) Since the three rollers, i.e., the pressure-contact roller, the tension steering roller and the heat roller are provided, the heat roller can be arranged at upstream side compared with a conventional drier. Thus, it is possible to set a heat roller vaporization temperature higher without increasing the surface temperature of the pressure-contact roller. Namely, while preventing ink picking caused by the pressure-contact roller, the recovery of the steam of solvent can be accelerated. This makes it possible to greatly decrease chances of image drying defects derived from ink contamination due to continuous printing operation, and to obtain a good image.

(7) Since the tension steering roller responsible for steering is separated from the heat roller for applying heat, the thermal expansion and contraction of the PET film which is the base material of the drying belt which occur due to the application of heat to the PET film, do not affect the operation of the toner image dryer, whereby the drier can conduct stable steering, that is, snaking control with a simple constitution without wrinkles and slacks.

What is claimed is:

1. A toner image dryer for a wet electrophotographic recording system for forming a toner image on a photosensitive body by a liquid development using a wet ink including toners and solvent, comprising:

a drying belt having a functional material coated on a film surface of a base material;

a pressure-contact roller which contacts with said drying belt to cause said drying belt to be contacted on the photosensitive body and rotates with the photosensitive body;

a heat roller for heating said drying belt; and tension application member for applying predetermined tension to said drying belt, and wherein said drying belt is rotated and moved to be thereby heated by said heat roller, and said drying belt absorbs and vaporizes the solvent from said photosensitive body.

2. The toner image dryer according to claim 1, comprising a cleaning mechanism for recovering ink adhering to said drying belt from said photosensitive body.

3. The toner image dryer according to claim 1, comprising rubber beads on a back surface of said drying belt.

4. The toner image dryer according to claim 2, comprising rubber beads on a back surface of said drying belt.

* * * * *